United States Patent [19]

Brüller et al.

[11] 4,203,477

[45] May 20, 1980

[54] MATERIAL WORKING MACHINE MOUNTING TOOLS IN SEVERAL PLANES

[75] Inventors: Eduard Brüller, Trimbach, Switzerland; Reiner Augenstein; Otto Bihler, both of Halblech, Fed. Rep. of Germany

[73] Assignee: Otto Bihler Maschinenfabrik GmbH & Co. KG, Halblech, Fed. Rep. of Germany

[21] Appl. No.: 940,271

[22] Filed: Sep. 7, 1978

[30] Foreign Application Priority Data

Sep. 15, 1977 [DE] Fed. Rep. of Germany ..... 2741576

[51] Int. Cl.[2] ..... B21F 1/00

[52] U.S. Cl. ..... 140/105; 72/384; 72/403

[58] Field of Search ..... 72/381, 383, 384, 403, 72/449, 394; 140/71 R, 105

[56] References Cited

U.S. PATENT DOCUMENTS

| | | | |
|---|---|---|---|
| 3,296,851 | 1/1967 | Breuer | 72/449 |
| 3,908,434 | 9/1975 | Ribback | 72/403 |

*Primary Examiner*—Lowell A. Larson

*Attorney, Agent, or Firm*—Toren, McGeady and Stanger

[57] ABSTRACT

A material working machine includes a plurality of workplates each capable of supporting one or more working units. The working units can be swung or rotated about an axis extending perpendicularly to the surface of the workplate. Each working unit mounts a tool carrier displaceable in a rectilinear manner into the path of a material across the workplates. At least two of the workplates extend angularly relative to one another and the angular position can be adjusted. One or two of the workplates form a slot adjacent the path of the material being worked and the tool carrier on a working unit mounted on a workplate not forming the slot is positioned to extend through the slot for effecting an operation on the material being worked.

27 Claims, 13 Drawing Figures

Fig.2
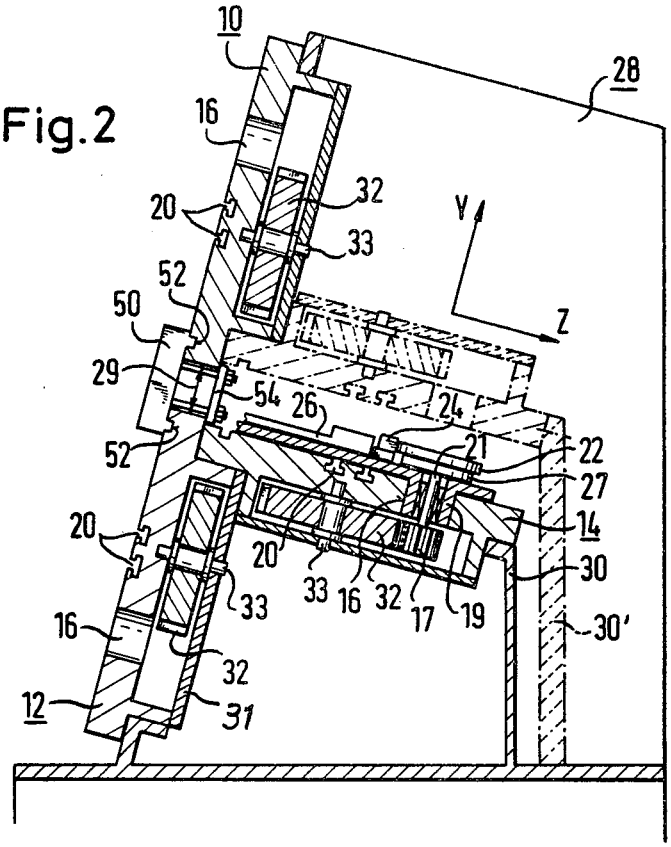
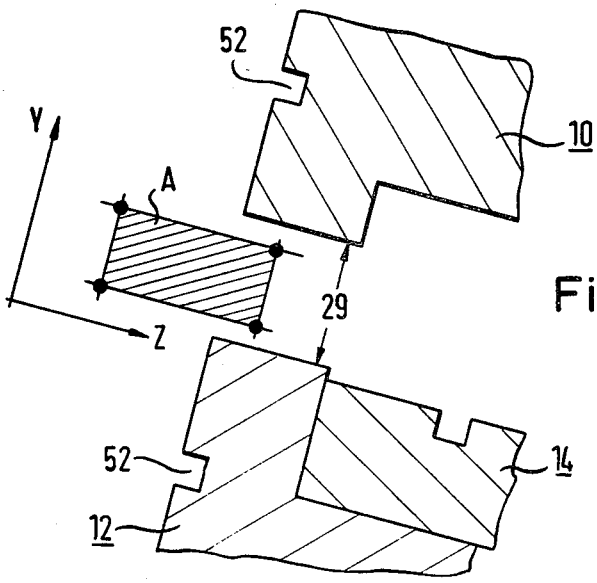
Fig.5

MATERIAL WORKING MACHINE MOUNTING TOOLS IN SEVERAL PLANES

BACKGROUND OF THE INVENTION

The present invention is directed to a material working machine for wire and ribbon material and particularly to an automatic punching and bending machine. The machine includes a workplate on which at least one working unit is mounted so that it can be swung or rotated in the plane of the plate. A tool carrier forms a part of the working unit and can be moved in a rectilinear manner into the path of the material being worked. The material to be worked is transported along a path forming a work area across the surface of at least one workplate.

Automatic punching and bending machines are known in which the working area, that is a bending station, is located in the center of a workplate and the workplate has receiving bores arranged in a circle about the center of the workplate for the selected insertion of material working or bending units. Each of the material working units includes a tool carrier movable in a rectilinear manner so that it can be moved in and out and the carrier mounts a bending or punching tool oriented toward the center of the workplate. Since the material working units can be swung or rotated about the axis of the receiving bores, its tool carriers can, within certain limits, be adjusted tangentially relative to the center of the workplate. Each material working unit has a control shaft for driving its tool carrier and the shaft extends through the receiving bore to the opposite surface of the workplate. At its end opposite the tool carrier, the control shaft supports a pinion. The pinion meshes with a central gear supported on the workplate and driven by the machine drive. In this particular automatic machine, the working of the material guided in the working area can only take place within the plane of the workplate or in a plane parallel to it, since the central gear prevents access to the working area from the rear surface of the workplate. To solve this problem, it has been suggested to replace the central gear with a chain drive so that the working area is accessible from the rear of the workplate. In such an arrangement, however, a chain wheel must be provided for each receiving bore so that a common chain is wound in a meandering manner around all of the chain wheels and also around a drive gear and this drive arrangement is necessary whether or not the material working units are inserted into each receiving bore. It is also possible and has been proposed to arrange a large flange with an opening at the above-mentioned central gear in the center of the machine, that is, at the support of the central gear, so that additional working operations can be carried out from the rear surface of the workplate through the opening in the flange. By enlarging the opening or passage in the flange, and by using appropriate control members more than one working operation can be carried out in the center or the operations can be staggered laterally. There are limits, however, to the extent to which the opening through the flange can be enlarged and in an extreme case the central gear would become a central toothed wheel. The limitation on size of the opening results from the fact that the support of such a toothed wheel would be very expensive. Further, material working units positioned on the rear surface are relatively heavy and the drive for such units is cumbersome, since it would have to be provided from the outer diameter of the toothed wheel.

In another known automatic bending machine, a substantially rectangular work plate is provided with an elongated working area located in the center of the plate. Material working units can be positioned on the workplate on both sides of the working area in the plane of the workplate and such units can be oriented in the plane of the workplate in any angular position relative to the working area. Moreover, additional working units can be located in a direction extending perpendicularly to the plane of the plate. The tool carriers for the working unit are operated hydraulically, accordingly, each working unit is connected to the drive through two hydraulic control lines. Due to its elongated working area, this automatic bending machine is better suited for working on elongated wire or ribbon materials than is the first machine mentioned above. This second machine is disadvantageous, however, because the many positions of the material working units in the plane of the workplate is effected by a hydraulic drive which in many instances is undesirable, and, further, the material working units located outside the plane of the workplate can be utilized only in a direction of action perpendicular to the workplate.

SUMMARY OF THE INVENTION

Therefore, it is the primary object of the present invention to provide a material working machine of the general type mentioned above which is particularly suitable for working on long wire and ribbon materials and permits the arrangement of the working units in at least two angularly disposed planes with the working action being applied in practically any direction.

In accordance with the present invention at least two workplates are disposed perpendicular to a common reference plane and the workplates are constructed to receive material working units which can be swung or rotated about an axis so that the movement is in the plane of the plate or in a plane parallel to it. Further, each working unit has a tool carrier which can be moved into a common working area, that is, a path of the material extending across the working plate.

In one arrangement in accordance with the present invention, a slot extends through a first workplate in parallel with its longer sides with the working area being located within or in front of the slot. The first workplate has a first surface on which the working units are mounted and across which the material being worked extends and an oppositely directed second surface. A second workplate is arranged on and extends from the second surface of the first workplate. A tool carrier mounted on a working unit on the second workplate is extendible through the slot into the working area. The angle between the first and second workplates can be adjustably selected.

In another embodiment of the present invention, the working machine includes three workplates and the angle between two of the workplates can be fixed or made adjustable. In one arrangement a first and a second workplate are positioned in the same plane, that is, the surfaces of the workplates extend in the same plane. In this arrangement the two workplates correspond to the first workplate in the above-mentioned embodiment. When three workplates are used, however, they can be all of the same shape and arrangement affording a reduction in manufacturing costs. In the case of three workplates, the first and second workplates are positioned to provide a slot between adjacent longitudinally extending sides. As with the previous embodiment, the third workplate extends from the surfaces of the first and second workplates on the opposite side from the working units and a tool carrier mounted on the third workplate is arranged to extend through the slot into the working area of the machine.

In a further advantageous feature of the invention, each of the workplates has receiving bores in which a material working unit can be mounted with the working unit rotatable or swingable about the axis of the bore. Accordingly, it is possible not only for the working units on the first and second workplates to be rotated in any direction of action but also the working unit on the third workplate can be similarly rotated so that its tool carrier can extend through the slot into the working area with the direction of movement of the tool carrier not required to be perpendicular to the path through the work area, but it can be disposed at any angle relative to the surfaces of the first and second workplates. Each material working unit includes a bearing attachment having an outer diameter corresponding to the diameter of the receiving bore and a control shaft is coaxial with the bore and extends through the attachment for driving the tool carrier. The end of the control shaft spaced from the tool carrier mounts a pinion which meshes with a spur gear when the material working unit is inserted into the receiving bore. A plurality of receiving bores is associated with each of the spur gears and the associated receiving bores are arranged on a circular arc concentric to the spur gear. Based on the desired position of the working unit along the path of the working area and the desired direction of the tool carrier, the working unit can be inserted into one of a number of the receiving bores while it is assured that its pinion will mesh with the spur gear. In place of a plurality of receiving bores disposed concentrically to the spur gear, each spur gear can have a corresponding circular arc-like slot concentric to the gear. While such a slot tends to significantly weaken the workplate, there is the advantage of an infinite adjustability of the positions of the working units along the direction of the slot.

In providing adjustability for positioning the working units, the opposite side of the workplates from the side forming a slot is constructed in the form of a series of circular arcs each being concentric to one of the spur gears. In such an arrangement, the bearing attachment supporting the control shaft and the drive pinion and also a cam disk for the drive of the tool carrier can be arranged separately from a support for the tool carrier. The bearing attachment can be mounted separately on the workplate, such as in a T-shaped groove arranged concentrically to the spur gear. The support in the T-shaped groove is provided by a U-shaped flange which encloses the edge of the workplate so that the free ends of the flange on both surfaces of the workplate are anchored in corresponding grooves extending concentrically to the spur gear. The flange is formed as a part of the bearing attachment and can be moved about the axis of rotation of the spur gear and clamped into the grooves in an infinite number of adjusted positions. The carrier support is mounted on the front side of the flange and can be moved around the axis of rotation of the control shaft.

Based on the length of the working area, at least one row of a plurality of meshed spur gears is arranged across each workplate. When three workplates are used, only one row of spur gears is required for each workplate. If only two workplates are used, then one of the workplates which forms the slot requires a row of spur gears on each side of the slot.

A transmission or drive gear can be provided for each row of spur gears with each of the transmission gears being driven through intermediate gears from a common drive shaft. It is possible, however, for the spur gears of two workplates arranged in the same plane to be connected to one another through an intermediate spur gear while the spur gears on a third workplate arranged in another plane can be driven by means of a bevel gear drive at any intermediate gear position. In such an arrangement one less bevel gear drive would be required. It is also possible for the rows of spur gears on two workplates arranged in the same plane to be connected through gears located between the rows.

It is advantageous if the spur gears for driving the material units are not of the same size and also if their centers are arranged in the workplate so that the receiving bores arranged about a respective spur gear are located on an arc having an approximately elliptical shape. Such an arrangement has the advantage that the material working units located on the outer ends of the working area can act at a wider angle relative to the ends of the material being worked, without the paths of the tool carriers or the lengths of the tools or the working units becoming too long.

The various features of novelty which characterize the invention are pointed out with particularity in the claims annexed to and forming a part of this disclosure. For a better understanding fo the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 2 is a cross-sectional side view of the embodiment illustrated in FIG. 1*a* including a showing of another workplate extending rearwardly from the front workplates;

FIG. 5 is an enlarged detail view of the working area provided between the two front workplates in FIG. 1*a* and illustrating the range of adjustment of the material path;

DETAIL DESCRIPTION OF THE INVENTION

Figure 1A:
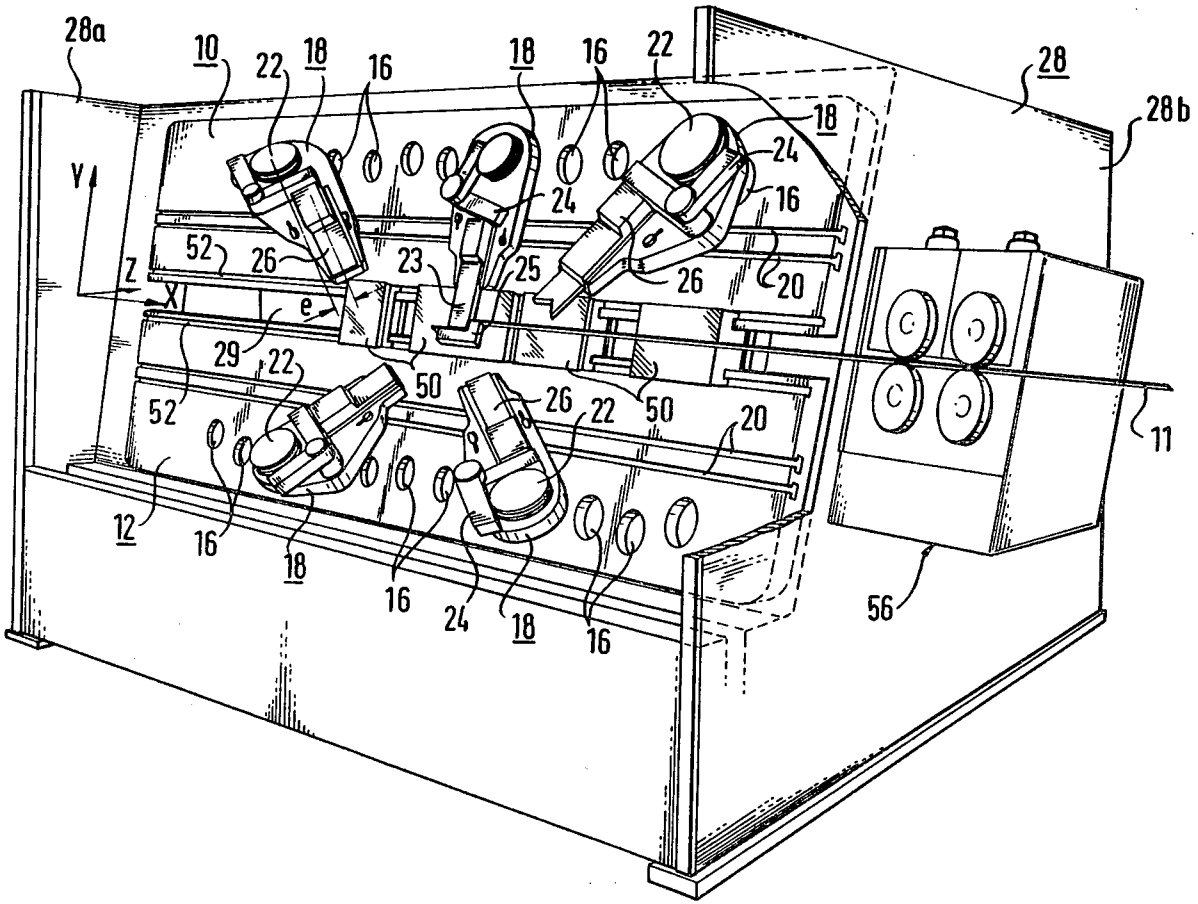
FIG. 1*a* is a perspective view of one embodiment of a material working machine incorporating the present invention.

In FIG. 1*a* an automatic punching and bending machine is illustrated containing three workplates, however, only the two front work plates 10 and 12 are shown. In this embodiment each of the workplates 10 and 12 has a front surface each arranged in the same plane. The third workplate 14 can be seen in FIG. 2 extending rearwardly from the rear surface of the workplates 10 and 12 with the third workplate disposed substantially perpendicularly to the front workplates. Each workplate has a row of receiving bores 16 into which the material working units 18 are inserted. Each row of receiving bores 16 extends in the same direction as the longer or first sides of the workplates. As shown in FIG. 2, a bearing attachment 19 extends through one of the receiving bores 16, note the rearwardly extending workplate 14, so that the work unit can be swung or rotated about the central axis of the receiving bore in which it is positioned. The material working units 18 can be secured in position by means of screws. These screws engage countermembers, not shown, and can be moved through the grooves in the long direction of the workplates. For reasons of cost, it is advantageous to replace the T-shaped grooves 20 extending along the length of the workplates by individual threaded bores, not shown, arranged relative to one another so that the material units can be secured in almost any rotated position about the center axis of each receiving bore 16. On the front end of each control shaft 21, that is, the end extending from the surface of the workplate on which the material working unit 18 is positioned, there is a cam disk 22 positioned on a cam disk support 27. As this cam disk rotates, it displaces a tool carrier 26 inwardly and outwardly in a linear direction via an intermediate lever 24 which is connected to a restoring spring, not shown. As shown in FIG. 1*a*, a punching or bending tool 23 is secured to one of the tool carriers 26 and this tool interacts with a corresponding part on another material working unit or with a stationary bending die 25 secured between the workplates 10, 12.

Workplates 10, 12 and 14 are supported in a housing or frame 28 in a suitable manner, not shown. The juxtaposed longitudinal edges of workplates 10 and 12 are spaced apart and form therebetween a slot or clearance 29. As shown in FIG. 2, a working unit 18 is mounted on the front surface of the workplate 14 while its oppositely directed rear surface rests, adjacent the workplates 10, 12 on a shoulder formed in the workplate 12 and the opposite side of the workplate is supported on a stationary frame piece 30. Further, in FIG. 2, in dotted lines the workplate 14 is shown in a reverse position supported against a shoulder on the workplate 10 and on the opposite side, on a column 30' mounted on the frame 28.

Figure 3:
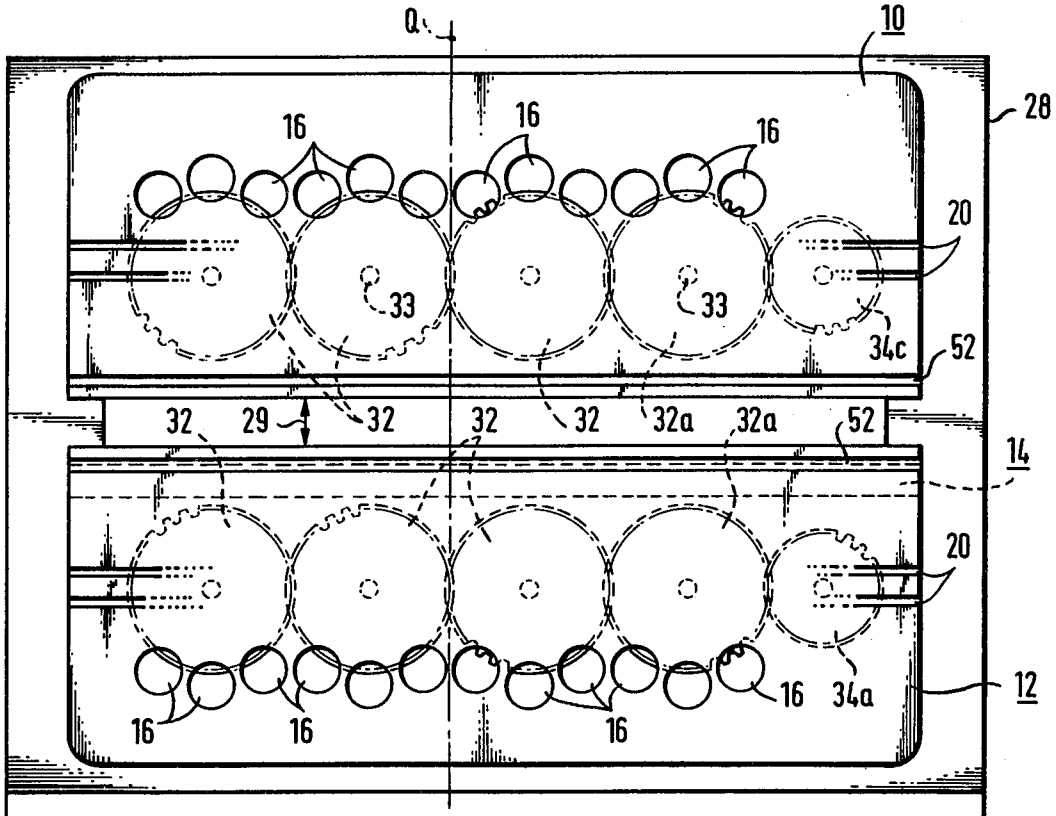
FIG. 3 is a front view of the embodiment shown in FIG. 1*a* illustrating the arrangement of the spur gears and transmission gears.

On the back surface of each of the identical workplates 10, 12 and 14 there is arranged a row of spur gears 32, note FIG. 3. The spur gears are freely rotatably mounted on shafts 33. In turn, the shafts are supported at one end in the associated workplate and at the other end in a cover 31 connected to the rear surface of the workplate. The spur gears of each workplate mesh with one another, note FIG. 3, and an outer spur gear **32*a* meshes with a transmission gear 34**. The transmission gear is connected to a machine drive as will be described later.

Each workplate contains a certain number of receiving bores 16 with the bores arranged in a plurality of circular arcs with each arc concentric to one of the spur gears 32. The control shaft 21 for each material working unit 18 carries the cam disk 22 via the cam disk support 27 and each shaft is supported in a separate bearing attachment 19. At the opposite end of the control shaft from the working unit, it extends outwardly from the bearing attachment 19 and mounts on a pinion 17, note FIG. 2. When a material working unit is inserted into one of the receiving bores 16 located on a concentric circular arc, the pinion 17 always meshes with the same spur gear 32.

As indicated above, instead of using a plurality of receiving bores located along a concentric circular arc, it is possible to provide arcuate slots provided concentrically about the spur gears 32, such slots are not shown in the drawing. Unlike the individual receiving bores, such slots will allow an infinite adjustability of the material working units without restricting the rotatability of the working units in each of their positions. Another possibility for adjusting the material working units concentrically to the spur gears into various positions will be explained later with regard to FIGS. 6 to 8.

Due to the meshed engagement of the spur gears 32 as illustrated and described, the direction of rotation of the spur gears within a row changes from one to another. This changing direction of rotation can be easily taken into consideration so that the surfaces of the cam disk 22 with the cam disk support rigidly connected to the control shaft are equal on both sides and the adjacent cam disks each having a different direction of rotation are screwed onto the cam disks accordingly. The most simple shape of the cam disks for this purpose is a disk having two essentially parallel principal surfaces.

Figure 1B:
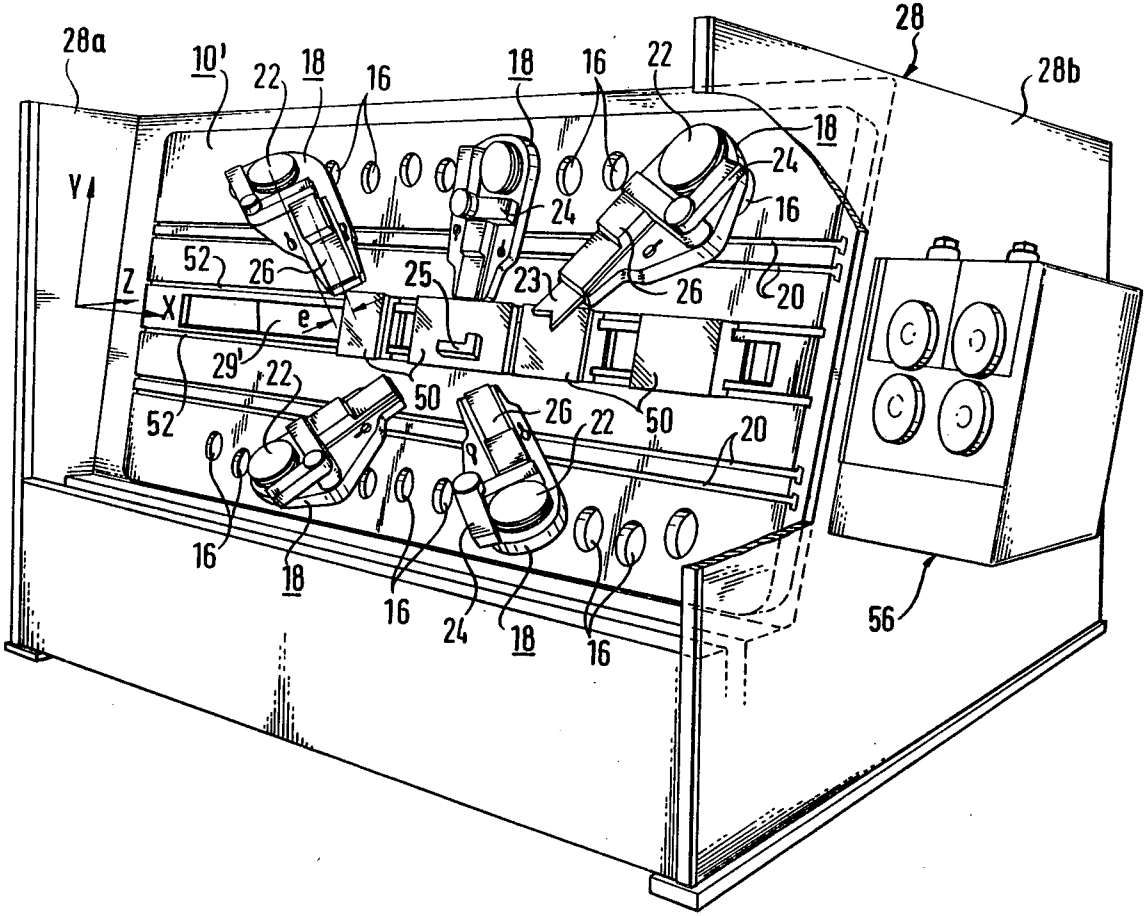
FIG. 1*b* is a perspective view of another embodiment of the invention similar to that shown in FIG. 1*a*, however, with a single front workplate instead of two similarly constructed workplates forming the front surface.

The difference in the arrangement shown in FIG. 1*b* as compared to FIG. 1*a* is not of great significance and amounts to replacing the two separate uniformly shaped workplates 10 and 12 with a single workplate 10' with the single workplate having a slot 29' corresponding generally to the slot or clearance 29. In other respects the description of the arrangement shown in FIG. 1*a* and in the other figures applies to the embodiment shown in 1*b* in which corresponding parts have the same reference numerals.

Figure 4:
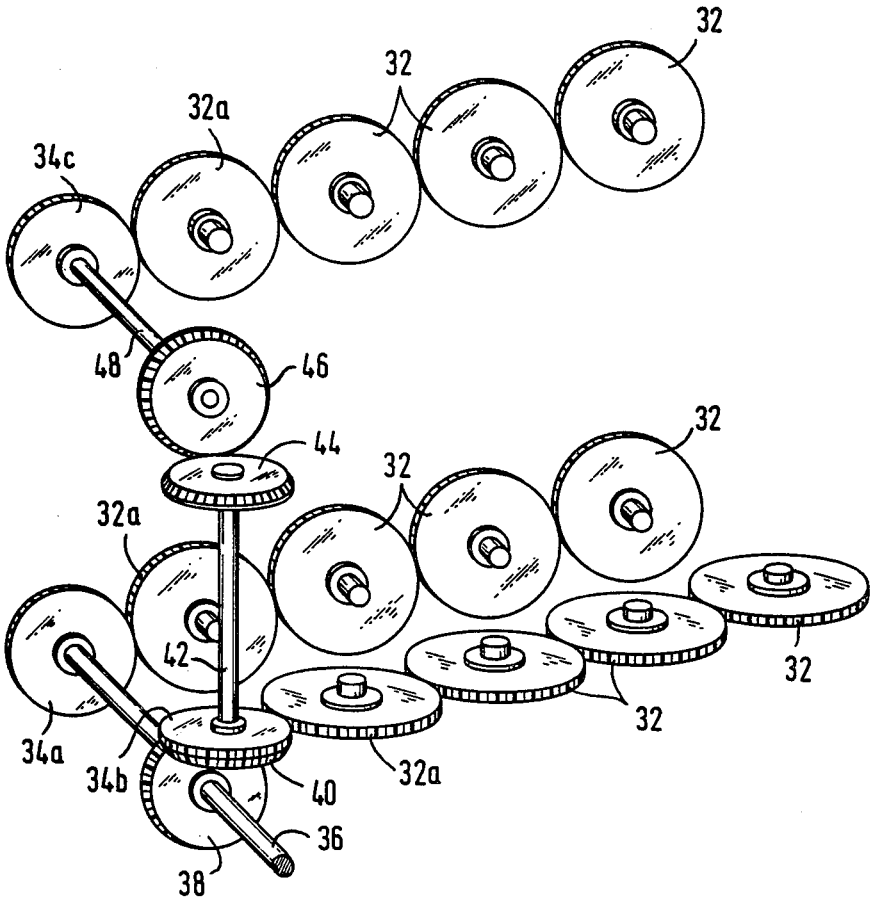
FIG. 4 is a schematic showing of the drive of the spur gears from a common drive shaft.

In FIG. 4 a schematic perspective view is shown of the drive of the transmission gears 34 for the spur gears. A drive shaft 36 connected to a machine drive, not shown, directly drives the transmission gear **34*a* for the lower front workplate 12. In addition, the drive shaft 36 carries a beveled gear 38 which drives another bevel gear 40 and an intermediate shaft 42 connected to it. Bevel gear 40 is connected to the transmission gear 34*b* of the rear workplate 14. At the upper end of the intermediate shaft 42 is another bevel gear 44 which drives a bevel gear 46 mounted on a second intermediate shaft 48, the other end of which is secured to transmission gear 34*c* for the upper front workplate 10. In turn, each of the transmission gears drives a spur gear 32*a* and then the remaining spur gears 32 so that any length of workplate can be used containing any number of spur gears 32** when suitable measure for adjusting the play between the individual spur gears is provided.

Basically it is not absolutely necessary to provide a transmission gear 34a, 34b, 34c to each row of the bevel gears 32. For example, it would be possible to connect each of the first spur gears 32a of the front workplates 10 and 12 through an intermediate spur gear, not shown, and to afford the drive of the spur gears 32 of the third workplate 14 through a bevel gear drive at any chosen position of the spur gears. As a result, one less bevel gear drive would be needed. Furthermore, the upper and lower rows of spur gears could be connected through gears located between the rows.

To compensate for the play in elongated workplates having a corresponding large number of spur gears 32, instead of using an end spur gear 32a, it would be possible to drive the individual rows of spur gears by a gear arranged approximately at the center of each row so that the added play of all the spur gears cannot occur within one of the spur gears. For an especially long machine embodying the present invention, it would be possible to provide a play compensating unit, not shown, at the last spur gear furthest from the drive or from the transmission gear. In the simplest case, such a unit could be a brake disk continuously under pressure which, through a pinion, acts on the last spur gear in a row of such gears. It is also conceivable to control the brake, in dependence on the working forces developed, so that the brake is effective only during certain periods of the work cycle. Furthermore, the braking force could also be obtained by means of a magnet. In addition, the braking force could be adjusted by controlling the magnet force. For example, a magnetic clutch could be provided. In another alternative, an inductive brake could be used. Preferably, a play compensating unit should be used which can be controlled and is not subject to wear.

As shown from the system of coordinates illustrated in FIG. 1a, the workplates 10, 12 are located in the XY-plane. The third workplate 14 extending transversely of the other workplates is in the XZ-plane. It would be possible without any difficulty to position the third workplate relative to the XY-plane at an angle other than 90°. Additionally, workplates 10 and 12, instead of being disposed in the same plane, could be arranged at an angle other than 180°, preferably an obtuse angle. An embodiment in which the angles between the workplates can be adjusted will be explained later with respect to FIGS. 11 and 12. Since the receiving bores are arranged in the same direction as the long sides of the workplates and because the material working units can be swung or rotated within a receiving bore in the XY-plane along the working area provided by the slot 29, the material working units 18 on the workplates 10, 12 can be moved in almost any direction. Similarly, the material working units on the rear workplate 14 can be located along the workplate at the distances predetermined by the receiving bores and can be swung in the plane of the plate or at least in a plane parallel to it into any position. Therefore, the direction of action of the tool carriers or their tools which can extend into or through the slot 29, is not necessarily perpendicular to the XY-plane, but can be adjusted to any angle relative to such plane.

In each bending procedure a bending tool is required with the outer contour of the shaped piece and another bending die or a core piece is needed having the inner contour of the shaped piece. Apart from the design of the tool and the shape of the workpiece, the bending die can be arranged in a stationary position or for additional bending operations, the bending die can be removed from its range of action or, if necessary, be inserted.

In FIGS. 1a, 1b, and 2, support members 50 are located in the slot 29 between the workplates 10 and 12 or the slot 29 through the workplate 10'. The support members 50 engage within grooves 52 in the surface of the workplate on which the working units are supported and adjacent the slot. The support members can be moved along the entire length of the workplates and, as shown in FIG. 2, can be secured in position by means of a counterplate 54. Primarily, the support members serve as mounting supports for fixed position bending dies 25, or as guide blocks for bending dies which are moved by means of the tool carriers. Moreover, due to their arrangement in the grooves 52, the support members 50 hold the two workplates 10, 12 or the single workplate 10' together and, thus, prevent the workplates from bending under the influence of the working force of the material working units or preventing an enlargement of the slot 29, 29'. Since these support members can be moved along the length of the plate, they can be adjusted to any shape of the workpiece and to any particular machining purpose. Further, the support members or a portion of them can be constructed as guide members for the material 11 to be worked. In FIG. 5 a schematic sectional view through the workplates 10, 12 and 14 is provided in the region of the slot 29. To perform various shaping operations, it is advantageous if the path of the material to be worked, note material 11 in FIG. 1a, can be adjusted within the shaded area A. Accordingly, due to the adjustment, the actual working area can be located within or outwardly of the slot 29 on the front surfaces of the workplates 10, 12, that is, the surfaces on which the working units are mounted, note FIGS. 1a and 1b.

The time required to work or machine a workpiece and, thus, the output of the machine, results from the time needed to feed the material, the actual working time, and the time needed for removing the shaped workpiece. The time used for feeding the material into the machine is not available for carrying out the actual working procedure. In complicated shaping procedures the time required for shaping is relatively long because of the control steps involved, that is, the control of the tool carrier by means of the cam disk which is distributed over a wide angle of the cam disk. A certain stroke can be obtained by means of a cam disk with a relatively high pitch of the cam when the angle of rotation is small or with a relatively small pitch of the cam when the angle of rotation is wide. Accordingly, the wider the angle of rotation, the smaller is the pitch of the cam and the more favorable is the action of the force applied and the distribution of the force. However, the feed time depends on the length to be fed and the velocity of the feed both of which cannot be increased arbitrarily, since long lengths of material must be accelerated and moved and, in addition, straightening forces must be applied in order to pull the material through a straightening apparatus arranged in front of the feed rollers. To overcome this problem, in accordance with the present invention, the material 11 is fed along an axis located in a plane spaced from the plane in which the material is worked. In FIG. 5, the material is fed by means of rollers 56 along the right-hand side of the machine through the area A, the material is severed by one of the material working units 18 and then the material is moved by the same or another working unit in the Z direction, note FIG. 5, into the actual working plane. When the tools are arranged in a suitable manner, the material piece which has been severed and moved into the actual working plane can be worked on while at the same time another length of the material is moved into position to be cut and moved into the working plane. The operation of moving a piece of the material from the feeding plane into the working plane can be combined with the step of removing a finished length of material from the working plane, so that the only time lost in the operation involves the movement of a severed piece of material from the feeding plane into the working plane. Accordingly, for a given capacity, the working time can be increased and the feeding speed kept within reasonable limits. When a bending operation is to be performed within an XY-plane, a material working unit 18 on one of the front workplates 10, 12 can be used in combination with a stationary bending die 25 on one of the support members 50. In place of a stationary bending die, a bending die can be employed which is movable in the XZ-plane and which is held on the rearward plate 14 by a tool carrier 26 on a working unit 18 so that it is moved, with suitable time control, through the slot 29 by means of the cam disk 22 and it is possible for it to be guided by one or several of the support members 50. If the bending operation takes place in the XZ-plane, the bending die, for example, a core piece, can be moved into the working area in the vicinity of the slot 29 by means of one of the working units 18 on the workplates 10, 12 while the bending tool is held by another working unit on the workplate 14 and is moved in the XZ-plane. Finally, a bending operation in the YZ-plane can be performed by a tool controlled in the XZ-plane and a bending die controlled in the XY-plane, possibly with deflection.

In FIGS. 1*a* and 1*b* a feed roller unit 56 is located at the right-hand side of the machine. In a known manner, these feed rollers supply a certain length of material within a given time (control angle of the machine drive). In place of the feed rollers, however, other feed members can be used such as feed tongs. The feed rollers are particularly suited for supplying elongated sections of material because of their unlimited feeding length. Furthermore, it is possible to position a second feeding unit on the left-hand side of the machine so that two different materials can be supplied, one from the right and one from the left, to deform both materials and to connect them in the working operation. Moreover, it is also possible to provide a feeding unit for the rear workplate 14 so that, depending on the type of workpiece involved, material can be fed in over the rear workplate.

Figure 6:
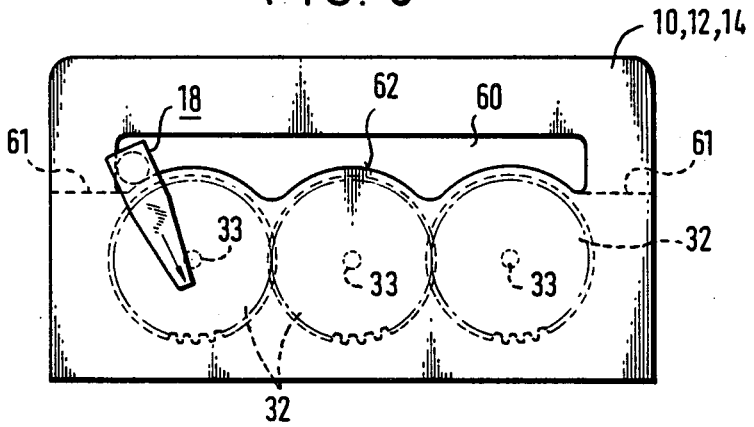
FIG. 6 is a front view of a workplate illustrating another embodiment of the present invention.

In FIG. 6 a schematic view is shown of another embodiment of the workplates 10, 12, 14 which could be used in place of the embodiment shown in FIGS. 1*a*, 1*b*, 2 and 3. In this figure the position of the spur gears 32 is indicated by their axes of rotation 33. While only three spur gears are shown, the total number could be more or less. On the opposite side of the spur gears from the slot 29, not shown in FIG. 6, the workplate has a cutout 60 defined on the side adjacent the spur gears by a row or series of circular arcs 62. Each of the circular arcs is located adjacent the periphery of one of the spur gears and is concentric with the associated spur gear. Over the extent of each circular gear 62, a material working unit 18 can be mounted within the cutout so that it can be rotated about the axis 33 of the spur gear 32. In FIG. 6 only one working unit 18 is illustrated, however, a plurality of working units could be provided.

Instead of forming part of the cutout 60, the circular arc 62 could be formed directly on the outer edge of the workplate as shown by the dotted line 61 in FIG. 6. In the embodiment illustrated in FIG. 6, the cutout 60 provides a higher strength for the workplate and can be anchored to the machine frame in the region of the cutout.

Figure 8:
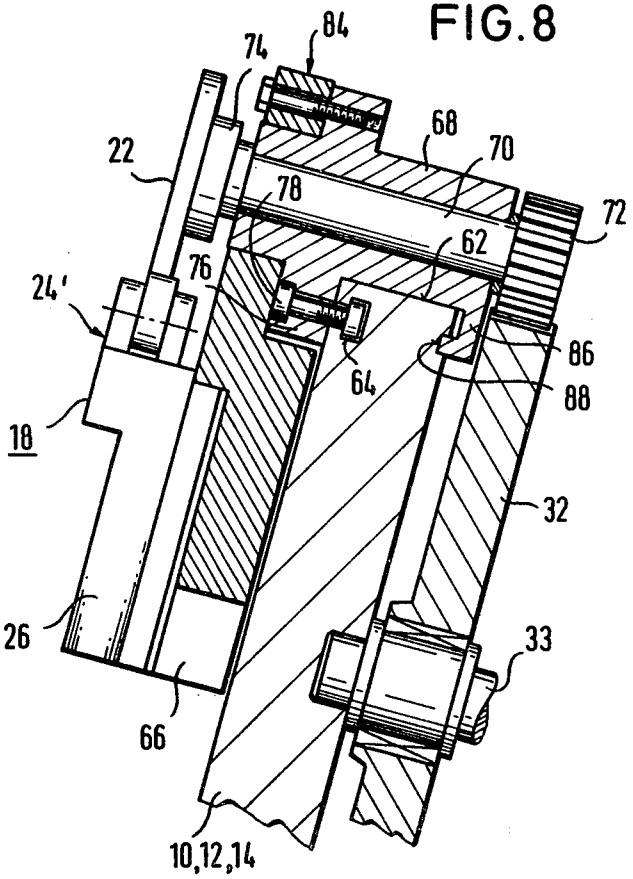
FIG. 8 is a sectional side view taken along the line VIII—VIII in FIG. 7.
Figure 7:
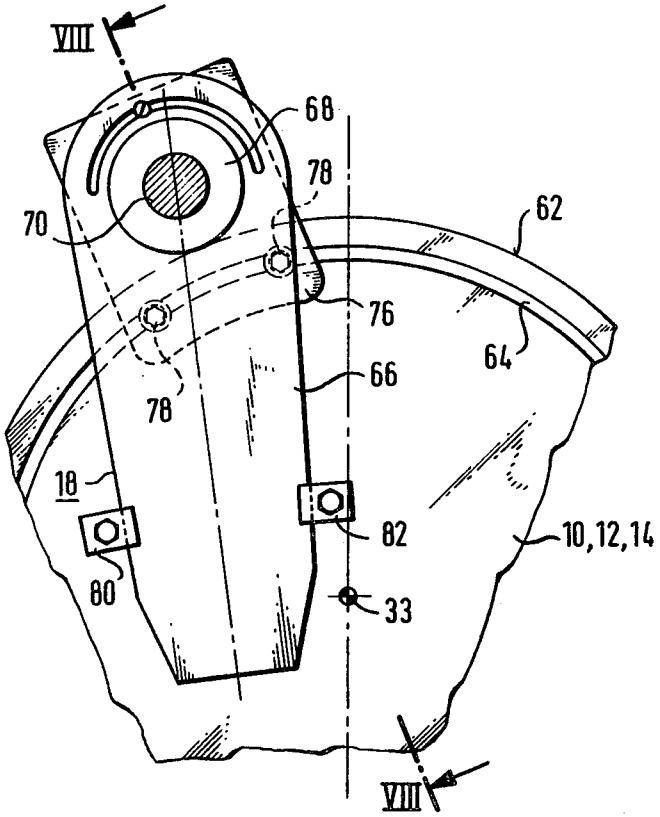
FIG. 7 is an enlarged detail view of a portion of FIG. 6.

In FIG. 7 an enlarged partial view of FIG. 6 is illustrated and, in combination with FIG. 8, the manner in which a material working unit is mounted can be noted. A groove 64 having a T-shaped cross-section is formed in the surface of the workplate 10, 12 or 14 on which a working unit is mounted. The groove 64 is concentric to the circular arc 62, that is the axis 33 forms its center. The material working unit 18 includes a carrier support 66 along with the tool carrier 26 and a flange portion 68. The flange portion 68 includes the bearing attachment for the control shaft 70. The end of the control shaft 70 on the rear surface of the workplate carries the drive pinion 72 which is in meshed engagement with a spur gear 32. The end of the control shaft adjacent the front surface of the workplate includes a cam disk support 74 on which the cam disk 22 is mounted. In turn, the cam disk is in engagement with a tool carrier 26 through a cam follower member 24' shown schematically in this figure. The bearing attachment of the flange 68 is located on the circular arc 62 along the upper edge of the workplate. An attachment 76 on the flange embraces the front surface of the workplate along its upper edge, that is the edge on which the circular arc is formed, and can be clamped to the workplate in a suitable manner, for example, by means of a screw 78 and a counterpiece guided in the groove 64, the counterpiece is not identified by a reference numeral. After the clamp is released, the flange along with the other parts of the working unit 18 can be moved concentrically to the axis 33 of the associated spur gear under the guidance of the circular arc 62 and the groove 64 and an infinite range of adjustments are available into which the unit can be clamped. As shown in FIG. 8, the carrier support 66 is positioned on a cylindrical part of the flange 68 so that it can be swung relative to the flange about the center axis of the control shaft 70. As indicated by reference numerals 80, 82 in FIG. 7, the carrier support can be clamped to the workplate in any selected position in a suitable manner. Further, at 84 in FIG. 8, the carrier support 66 and the flange 68 can be clamped together or locked relative to one another.

In FIG. 8, an arm 86 on the flange 68 projects beyond the circular arc 62 along the rear surface of the workplate so that the flange in a U-shaped manner embraces the circular arc upper edge of the workplate. The edge of the workplate with the circular arcs is, of course, not necessarily the upper edge, it could be the lower edge on the workplate 12, however, the term upper edge is used for convenience in view of the illustration provided in FIGS. 7 and 8. The projection from the arm 86 engages in a rectangularly shaped groove 88 formed on a circular arc about the axis 33. It is also possible, however, to provide the groove 88 in a T-shaped manner affording the possibility of another clamped connection.

Figure 9:
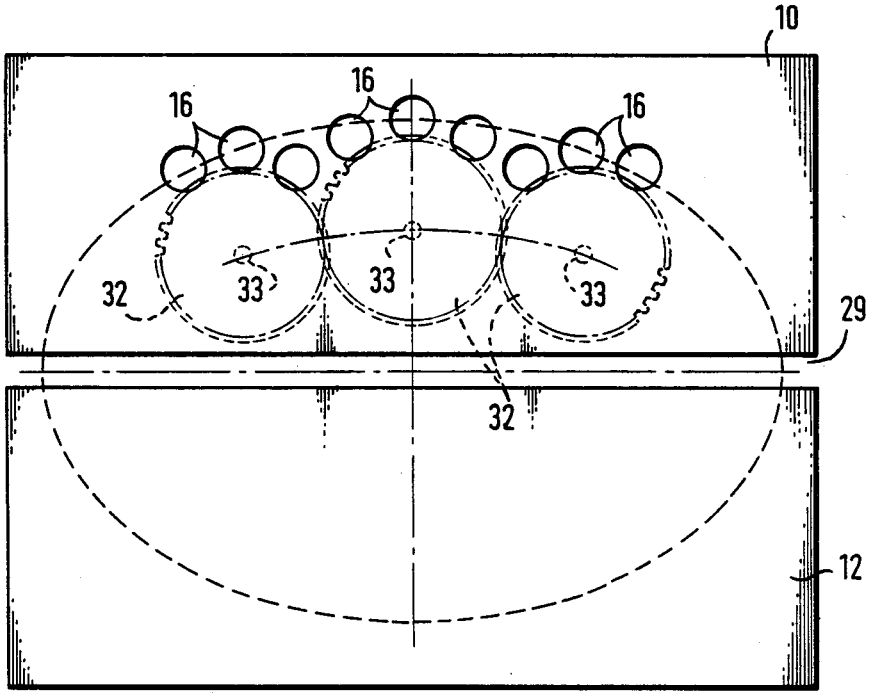
FIG. 9 is a front view illustrating the arrangement of the receiving bores corresponding to a row of spur gears.

In FIG. 9 the front surfaces of the workplates 10, 12 are shown indicating a preferred arrangement of the spur gears 32 and the associated receiving bores 16. While the spur gears 32 and the receiving bores 16 are only shown in workplate 10, it should be noted that the arrangement of the spur gears and receiving bores would be the same in workplate 12. As illustrated, the axes 33 of the spur gears are not arranged along a straight line parallel to the slot 29, rather they are arranged along an arc so that the receiving bores are located approximately along an elliptical arc. It can be seen that the diameters of the spur gears on the outside are smaller than the center spur gear. As compared to the arrangement shown in FIG. 3, this disposition of the spur gears 32 and receiving bores 16 has the advantage that the associated material working units, not shown in FIG. 9, located outwardly, that is, near the lateral edges of the workplate, require, at the same angle for the direction of action, relatively shorter travel paths for the tools or shorter tools or material working units for working on a section of the material.

Figure 10:
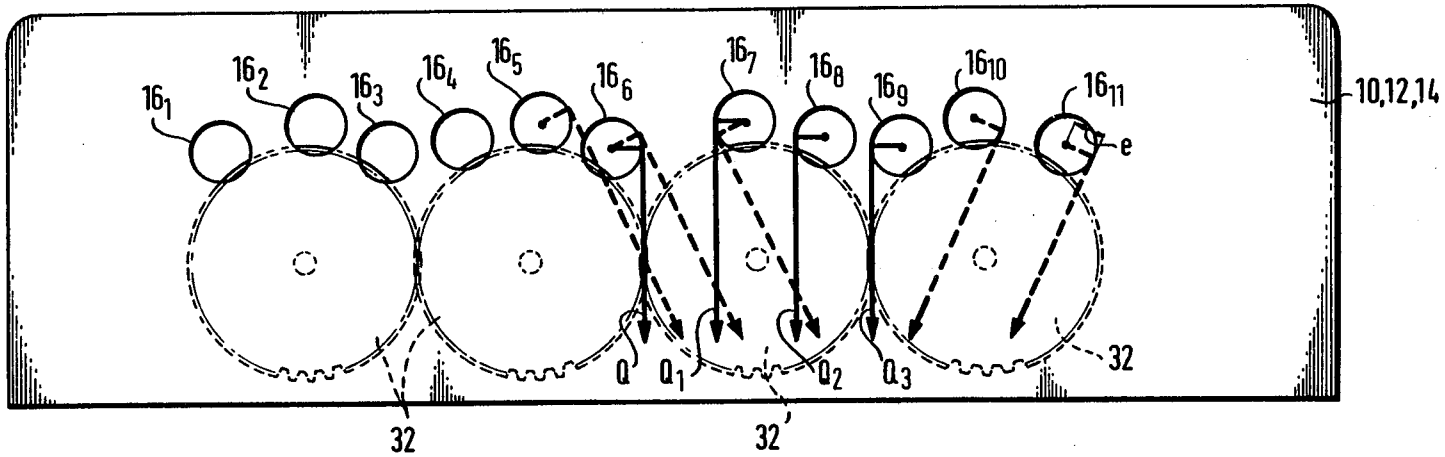
FIG. 10 is a view of a working plate showing the arrangement of a plurality of receiving bores relative to corresponding spur gears.

Still another advantageous arrangement of the receiving bores is afforded as shown in FIG. 10. With regard to this arrangement it must be noted that many of the workpieces are to be shaped symmetrically relative to a straight line which is perpendicular to the feed axis, that is perpendicular to the direction of the slot. Accordingly, the tools should be arranged symmetrically. Such an arrangement has the advantage that the tools for shaping the left end and the right end of a workpiece can be mounted in a mirror-image manner effecting a reduction in costs. When the receiving bores for the material working units are arranged symmetrically to the axis Q (FIG. 3), the symmetrical arrangement of the working units can only be provided when the center of the workpiece is located at the axis Q. Since the length of the workplates is determined by the maximum length of the workpiece to be worked, this arrangement means, compared to the length of the workplate, a relatively short workpiece must be moved to the middle of the workplate and must be worked in this location if the symmetrical arrangement is to be utilized. As a result, a length of material must be guided between the feed mechanism and the material working or bending area. The provision of members to provide such guiding action could be relatively expensive and, in addition, in the case of a relatively long path of travel and a small cross-section of the material, during the movement of the material it may have the tendency to yield or buckle resulting in a lateral force and causing friction on the guide surfaces even though the guidance of the material is efficient and exact.

Therefore, to overcome this problem the arrangement in FIG. 10 is provided with a number of additional axes of symmetry $Q_1$, $Q_2$ etc. located between the axis Q and the feed device on the right-hand side of the machine, not shown in FIG. 10. Accordingly, when a long workpiece is to be worked, the material working units can be symmetrically arranged relative to the axis Q, while if shorter lengths are involved, they can be arranged symmetrically to one of the other axis of symmetry $Q_1$, $Q_2$, etc. Accordingly, the material being fed and worked need only be guided along a length corresponding to the length of the workpiece and the available axis of symmetry. To achieve the desired effect, the position of the receiving bore 16 must be taken into consideration and, as a rule, the center of the cam disk 22 and the axis of the direction of action of the tool carrier are staggered by the distance e, note FIGS. 1 and 10, which is about 50 to 60 mm. In FIG. 10 a view of a workplate 10, 12, 14 is illustrated in scale with properly arranged receiving bores 16. This arrangement is based on the premise that the distance for staggering the material working units 18 is exactly equal to the radius of the receiving bores 16. In the arrangement of FIG. 10, material working units can be positioned in the receiving bores $16_1$ and $16_{11}$, $16_2$ and $16_{10}$, $16_3$ and $16_9$, $16_4$ and $16_8$, and $16_5$ and $16_7$ symmetrically to a material working unit inserted in a receiving bore with its tool carrier acting vertically downwardly. In a corresponding manner, material working units can be arranged in the receiving bores $16_5$ and $16_{11}$ and also $16_6$ and $16_{10}$ so that they act on a workpiece essentially symmetrical to the direction of action of a material working unit inserted into the receiving bore $16_8$. Similar symmetrical arrangements result with the use of the receiving bores $16_2$ and $16_{11}$ and $16_3$ and $16_{10}$ with respect to the axis of symmetry $Q_1$ represented by an arrow which corresponds to the vertical direction of a material working unit mounted in the receiving bores $16_7$. Material working units in the receiving bores $16_6$ and $16_{11}$ and $16_7$ and $16_{10}$, etc., are essentially symmetrical to the line of symmetry $Q_3$. In total, four spur gears 32 are associated with the receiving bores $16_1$ to $16_{11}$ as shown in FIG. 10. The arrows each represent the direction of action of the tool carriers of the material working units inserted into the corresponding receiving bores. The description concerning FIGS. 9 and 10 is also applicable to the workplate 10' as shown in FIG. 1*b*.

The following is a description of yet another embodiment of the invention in which the angle between the workplates can be adjusted.

Figure 11:
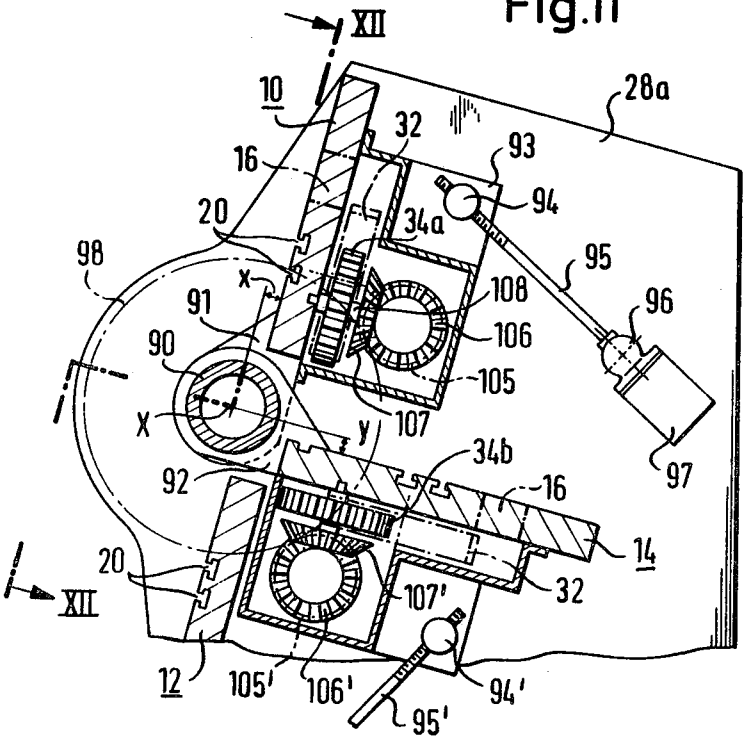
FIG. 11 is a side view, partly in section, of another embodiment of the present invention.

FIG. 11 is a side view, partly in section, of this embodiment of the invention. While the embodiment shows two separate workplates 10, 12 as illustrated in FIG. 1*a*, it is also applicable to a single workplate 10' as displayed in FIG. 1*b*. The parts in this embodiment which correspond to the previous embodiments are designated by the same reference numerals. Only the features in this embodiment which distinguish over the others will be explained.

Figure 12:
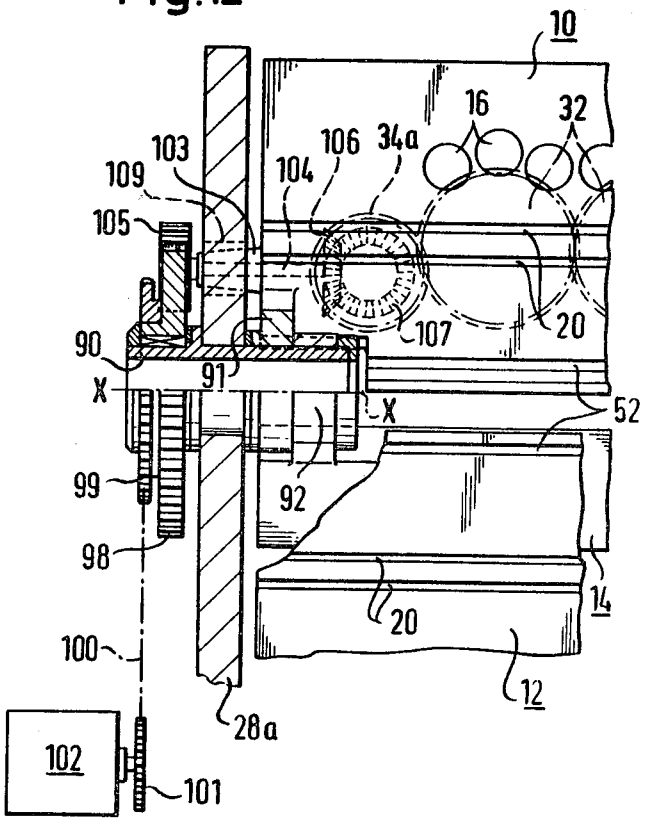
FIG. 12 is a view taken along the line XII—XII in FIG. 11.

FIG. 12 is a sectional view taken along the line XII—XII in FIG. 11.

In each of the two side walls 28*a* and 28*b* of the frame 28, note FIG. 1*a*, in FIGS. 11 and 12 only the side wall 28*a* is shown, a pivot bearing bushing 90 is mounted in a bore. The bushing 90 is in the form of a hollow cylinder whose bore is aligned with the slot 29 between the workplates 10, 12 so that the material 11, not shown in these figures, can be fed into the working area through the bushing 90. At the opposite ends of the upper front workplate 10 and the rear workplate 14 are mounted an arm 91 (workplate 10) and 92 (workplate 14). The arms 91, 92 have bores which correspond to the outer diameter of the bearing bushing 90 and receive the bearing bushing so that the workplates 10, 14 can be swung or rotated about the center axis X of the bushing. As shown in FIG. 11, the center axis X of the bearing bushing 90 is positioned at a distance x above the surface of the workplate 10 and at a distance y above the surface of the workplate 14. By displacing the workplate 14 which is pivotably supported on the bearing bushing 90 through the two arms 92, its angle relative to the stationary workplate 12 as the reference plane can be changed and adjusted to any desired angle. The workplate 10 which is supported in a similar manner can be rotated relative to the reference plane so that the angle of the three workplates relative to one another can be adjusted to any desired position.

Angular adjustment of the workplates 10, 14 can be carried out manually or mechanically. A bolt 94 is rotatably supported on a flange plate 93 connected to the workplate 10. The bolt has a threaded bore extending perpendicularly to its longitudinal axis with a spindle 95 threaded into the bore. In respect to its longitudinal direction, the spindle is stationary. However, the spindle can be rotated about its longitudinal axis and about an axis which is parallel to the axis X by means of a swivel joint 96 located at the side wall 28a of the frame 28. The end of the spindle 95 adjacent to the swivel joint 96 can be connected to the output shaft of a motor 97 so that the spindle is rotated about its axis when the motor actuated. It is not necessary to explain in detail that rotation of the spindle 95 about its axis leads to a rotation of the workplate 10 about the center axis X of the bearing bushing 90, since the spindle cannot be moved in the longitudinal direction. During this swinging movement of the workplate 10, the spindle rotates about the axis of rotation of the swivel joint 96 while the bolt 94 rotates in the flange plate 93. It is obvious that the direction in which the workplate moves depends on the direction of rotation of the spindle 95. A corresponding adjustment device can be provided for a workplate 14 as indicated by bolt 94' and a portion of a spindle 95', note the lower part of FIG. 11. If necessary, suitable locking means can be provided to fix the working plates 10, 14 in position. Such locking means are not shown in the drawing.

Spur gears 32 for the rotatably displaceable workplates 10, 14 are driven in the following manner. Outwardly from side wall 28a, a spur gear 98 is freely rotatably mounted on the bearing bushing. A chain wheel 99 is trained over spur gear 98 and, in turn, is driven by a chain wheel 101. Chain wheel 101 is coupled to a machine drive 102 shown schematically in FIG. 12. In a bearing attachment 103 for the workplate 10 (the corresponding bearing attachment for the workplate 14 is not shown in FIGS. 11 and 12) there is mounted a shaft 104 which, on the outside of side wall 28a, mounts the spur gear 98 meshed with a pinion 105. Bevel gear 106 is in meshed engagement with bevel gear 107 corresponding to bevel gear 46 in FIG. 4 and drives the transmission gear 34a of the workplate 10 through a short intermediate shaft 108 corresponding to the shaft 48 of FIG. 4. A recess 109 having the shape of a circular arc is provided in the side wall 28a and the bearing attachment 103 and the shaft 104 are movable through the recess and pass through the side wall 28a so that they can move about the axis X. When the workplate 10 is moved around the axis, the pinion 105 rolls on the spur gear 98 without any change in the described arrangement of the various gears. Accordingly, the drive for the spur gears 32 is independent of the position into which the workplate is rotated.

The drive for the spur gears in the workplate 14 is carried out in a similar manner. Accordingly, a pinion 105' interacts with a bevel gear 106' through a shaft, not shown, in the drawing. Bevel gear 106' corresponds to bevel gear 38 in FIG. 1 and meshes with bevel gear 107' which corresponds to bevel gear 40 of FIG. 4. Bevel gear 107' is arranged coaxially with the transmission gear 34b and is rigidly connected to it. The transmission gear 34b is in engagement with the bevel gears 32 of the workplate 14 as described with respect to FIG. 4. This drive transmission is not influenced by the position into which the workplate is moved about the axis.

When the spur gear 98 and the pinions 105, 105' have an appropriate construction with respect to strength and support, the workplates 10, 14 can be moved in the following manner when care is taken on the drive side that the spur gear rotates very slowly. The pinion 105, 105' of the workplate to be moved about the axis is secured rigidly against rotation during the swinging procedure to the corresponding bearing attachment 103 and, thus, to the corresponding workplate. When the spur gear 98 is rotated in the desired direction of rotation, the workplate is moved by the angle of rotation of the spur gear. As soon as the desired angle of rotation is achieved, the rigid connection of the pinion 105, 105' to the bearing attachment 103 can be released. In this case, the adjustment device for elements 93 to 97 would not be needed. Further, in this case suitable clamping devices are required to fix the workplates in position after the desired rotational adjustment has been effected.

Although the material working units 18 have been illustrated and described utilizing a cam disk 22 for controlling the tool carriers 26, the cam disk could be replaced in a known manner by a simple eccentric, not shown, particularly when the material working units are primarily used for punching.

In the description of the rotation of the material working unit about the axis passing through the associated workplate it has been described that the working unit swings or rotates in the plane of the associated workplate, however, this does not mean that its movement is in the plane of the surface of the workplate but rather that it rotates in a plane parallel to and closely adjacent to the surface of the workplate.

While specific embodiments of the invention have been shown and described in detail to illustrate the application of the inventive principles, it will be understood that the invention may be embodied otherwise without departing from such principles.

We claim:

1. Material working machine such as an automatic punching and bending machine comprising a workplate unit said workplate unit comprising two workplate sections, said workplate sections being spaced from one another and forming a longitudinal slot therebetween extending across at least a part of the area of said workplate unit, at least one material working unit mounted on each of said workplate sections for movement in the plane of said workplate section on which it is mounted about an axis extending through the plane of said workplate section on which it is mounted, said working unit including a tool carrier mounted thereon for movement along a rectilinear path, means for moving a material to be worked over the planes of said workplate sections along a path substantially extending along the longitudinal direction of said slot and forming a working area into or through which said tool carrier is movable, wherein the improvement comprises that at least one further workplate unit arranged in a plane parallel to the longitudinal direction of said slot and defining an angle with the plane of each of said workplate sections, a further working unit mounted on said further workplate unit and being movable in the plane of said further workplate unit and about an axis extending through said further workplate unit, and a tool carrier on said further working unit and being oriented for movement toward said slot and the working area.

2. Material working machine, as set forth in claim 1, wherein at least said workplate sections are angularly adjustable relative to one another.

3. Material working machine, as set forth in claim 2, wherein at least the angle between said further workplate unit and one of said further workplates is at least 90°.

4. Material working machine, as set forth in claim 1, wherein said workplate sections and said further workplate unit are each of the same size and shape.

5. Material working machine, as set forth in claim 1, wherein said workplate sections comprise a first workplate having a first pair of sides, said slot formed in said first workplate and spaced from and extending parallel to said first pair of sides, said first workplate having a first surface facing toward the working area and a second surface facing in the opposite direction from said first surface, said further workplate unit comprising a second workplate located on said second surface side of said first workplate and disposed angularly to said first workplate, said further working unit mounted on said second workplate with said tool carrier thereon being displaceable toward said slot in said first workplate.

6. Material working machine, as set forth in claim 5, wherein said second workplate has a pair of first sides with one of said first sides connected to said first workplate and extending along one side of said slot therein.

7. Material working machine, as set forth in claim 5 or claim 6, wherein said second workplate is disposed substantially perpendicularly to said first workplate.

8. Material working machine, as set forth in claim 1, wherein said two workplate sections comprise a first workplate and a second workplate, said first and second workplates each having a pair of first sides, one first side on each of said first and second workplates being disposed in closely spaced relation and forming a slot therebetween, said first and second workplates each having a first surface and an oppositely directed second surface with said first surface of each facing toward the working area, said further workplate unit comprises a third workplate located on the second surface side of said first and second workplates and having a first surface and an oppositely directed second surface, and said further working unit mounted on the first surface of said third workplate and having said tool carrier thereon positioned for extending through said slot between said first and second workplates.

9. Material working machine, as set forth in claim 8, wherein said third workplate has a pair of first sides with one of said first sides connected to one of said first and second workplates and extending along one side of said slot between said first and second workplates.

10. Material working machine, as set forth in claims 8 or 9, wherein said first surfaces of said first and second workplates are disposed in the same plane.

11. Material working machine, as set forth in claim 10, wherein said first surface of said third workplate is disposed substantially perpendicularly to the first surface of said first and second workplates.

12. Material working machine, as set forth in claim 1, wherein each of said workplate sections and said further workplate unit has a plurality of receiving bores extending therethrough and each said receiving bore arranged to receive one said working unit for swingably supporting said working unit about the axis of said bore.

13. Material working machine, as set forth in claim 12, wherein said working units mounted on said workplate sections and said further workplate unit each have a bearing attachment having an outer diameter corresponding to the diameter of said receiving bores and a control shaft coaxial with and extending through said bearing attachment, said control shaft drivingly connected to said tool carrier of said working unit, said control shaft having an end spaced outwardly from said tool carrier on said working unit, a pinion on the end of said control unit spaced outwardly from said working unit and a spur gear mounted on the opposite surface of each said workplate section and said further workplate unit from the surface adjacent said working unit and said spur gear disposed in meshed engagement with said pinion.

14. Material working machine, as set forth in claim 13, wherein a plurality of receiving bores in each said workplate section and said further workplate unit are arranged in cooperating relationship with one of said spur gears so that one said control shaft can be placed in one of the plurality of said receiving bores for engagement with the cooperating said spur gear, and the plurality of said receiving bores disposed on a circular arc concentric to the cooperating said spur gear.

15. Material working machine, as set forth in claim 13, wherein an arcuate slot is formed in each said workplate section and said further workplate unit and is arranged in cooperating relation with one of said spur gears so that one said control shaft can be positioned along said arcuate slot for engagement with said spur gear in a plurality of locations, and said arcuate slot being concentric to said spur gear.

16. Material working unit, as set forth in claims 14 or 15, wherein each said workplate section and said further workplate unit has a pair of first sides, a row of meshed said spur gears mounted on each said workplate section and said further workplate unit and located between and extending in the general direction of said first sides.

17. Material working machine, as set forth in claim 16, wherein at least one of the first sides on each of said workplate sections forming a slot therebetween, the other first sides on said workplate sections forming the slot being formed by a series of circular arcs each concentric to one of said spur gears mounted on said workplate sections, each said bearing attachment of said working unit having a flange thereon, a carrier support mounted on said flange for guiding said working unit on one of said circular arcs, the first surface of each said workplate section adjacent said working unit having a groove formed therein with said groove being concentric to one of said circular arcs for receiving said flange on said working unit and said bearing attachment being displaceable along the first side of said workplate section formed by said circular arcs, and means for clamping said working unit into said groove so that said working unit is infinitely adjustable along said circular arc.

18. Material working machine, as set forth in claim 17, wherein said flange is U-shaped and embraces each of the opposite surfaces of said workplate section along the other first side thereof formed by said circular arcs and extend into said grooves in the opposite surfaces of said workplate section adjacent the other said first side.

19. Material working machine, as set forth in claim 18, wherein the axis of said spur gears are arranged in a line extending in the same direction as the first side of said workplate section mounting said spur gears and said receiving bores are located along an elliptical arc with the long axis of the elliptical arc extending in the same direction as the first sides of said workplate section.

20. Material working machine, as set forth in claim 18, wherein the axes of said spur gears are arranged in a line extending in the same direction as the first sides of said workplate section and in the first side of said workplate section opposite the first side forming the slot having a series of circular arcs located along an elliptical arc with the long axis of the elliptical arc extending in the same direction as the first sides of said workplate section.

21. Material working machine, as set forth in claim 19, wherein the diameter of said spur gears increase from the opposite ends of said row thereof to the center of said row.

22. Material working machine, as set forth in claim 21, including a transmission gear for each said row of spur gears on each said workplate section, a common drive shaft for each of said transmission gears, and intermediate gears extending between said drive shaft and said transmission gear.

23. Material working machine, as set forth in claim 8, including a groove formed in the surface of said first and second workplates facing toward said working units, said groove being adjacent to and parallel with said slot between said first and second workplates, and support members positioned within said groove for holding said workplates together.

24. Material working machine, as set forth in claim 23, wherein a stationary bending die is mounted in said support members positioned in said groove.

25. Material working machine, as set forth in claim 23, wherein bending dies are located in said support members in said groove with said support members acting as a guide for said bending dies which are movable along said groove by said tool carrier.

26. Material working machine, as set forth in claim 23, wherein said support members are movable along the length of said groove in said workplate, and said support members are arranged to be clamped in position to said workplates.

27. Material working machine, as set forth in claim 14, wherein each said workplate section and said further workplate unit having a row of said spur gears extending thereacross in the direction of said first sides thereof has a plurality of imaginary axes of symmetry extending transversely of the first sides, a plurality of said working units positionable in said working bores in a symmetrical arrangement relative to one of the imaginary axes of symmetry, said imaginary axes of symmetry extending approximately perpendicularly to the path of the material movable across said workplate sections by said means for moving the material.

* * * * *